US009175501B2

(12) United States Patent
Nazzari

(10) Patent No.: US 9,175,501 B2
(45) Date of Patent: Nov. 3, 2015

(54) ROTARY SECURITY SEAL

(71) Applicant: NIC PRODUCTS, INC., Walnut Creek, CA (US)

(72) Inventor: Ian A. Nazzari, Maraga, CA (US)

(73) Assignee: NIC Products, Inc., Walnut Creek, CA (US)

( * ) Notice: Subject to any disclaimer, the term of this patent is extended or adjusted under 35 U.S.C. 154(b) by 0 days.

(21) Appl. No.: 14/276,128

(22) Filed: May 13, 2014

(65) Prior Publication Data

US 2014/0338405 A1 Nov. 20, 2014

Related U.S. Application Data

(60) Provisional application No. 61/823,124, filed on May 14, 2013, provisional application No. 61/936,257, filed on Feb. 5, 2014.

(51) Int. Cl.
*G09F 3/03* (2006.01)
*E05B 15/00* (2006.01)

(52) U.S. Cl.
CPC ..... *E05B 15/00* (2013.01); *G09F 3/0364* (2013.01); *Y10T 70/402* (2015.04)

(58) Field of Classification Search
CPC ..... F16L 33/14; F16G 11/12; B60P 7/083; Y10T 24/1416; Y10T 24/2187
USPC ..... 292/307 R, 315, 316, 318–321, 323, 292/325, 326, 307 A, 307 B, 327, 328, 330, 292/DIG. 16; 24/909; 242/338.1, 388.6; 70/14, 20, 30, 49, 50
See application file for complete search history.

(56) References Cited

U.S. PATENT DOCUMENTS 210,641 A 12/1878 Smith et al.
409,034 A 8/1889 Gillespie
(Continued)

FOREIGN PATENT DOCUMENTS

DE 2 262 421 A1 7/1973
EP 0 537 400 A1 4/1993
(Continued)

OTHER PUBLICATIONS

International Search Report and Written Opinion of the International Searching Authority from corresponding PCT Application No. PCT/US2014/037797, mailed Sep. 18, 2014.
(Continued)

*Primary Examiner* — Alyson M Merlino
(74) *Attorney, Agent, or Firm* — Workman Nydegger

(57) ABSTRACT

A rotary security seal assembly is disclosed for sealing container closures, meters, equipment and various other articles. The assembly is configured to reveal surreptitious entry or attempted access into or to a sealed area or article and comprises a housing body and a locking filament. The housing body includes a socket and a housing locking filament receiving bore extending at least in part through the housing body and intersecting the socket. The locking filament has a first end area and a second end area. The first end area of the locking filament is permanently secured to the housing body by hardened molding material forming the housing body. The second end area of the locking filament is dimensioned and configured to be received in and extended at least in part through the housing locking filament receiving bore leaving a continuous locking filament loop outside the housing body when so received.

9 Claims, 11 Drawing Sheets

(56) References Cited

U.S. PATENT DOCUMENTS

| | | | |
|---|---|---|---|
| 511,642 | A | 12/1893 | Nadon |
| 998,878 | A | 7/1911 | Dinsmoor |
| 1,054,440 | A | 2/1913 | Murray |
| 1,059,689 | A | 4/1913 | Webb |
| 1,079,839 | A | 11/1913 | Ciernia |
| 1,131,085 | A | 3/1915 | Reilly |
| 1,132,970 | A | 3/1915 | Peyton |
| 1,381,975 | A | 6/1921 | Dumais |
| 1,512,632 | A | 10/1924 | Oconnor |
| 1,626,273 | A | 4/1927 | Dietze |
| 1,647,398 | A | 11/1927 | Draheim et al. |
| 1,727,754 | A | 9/1929 | Dessauer |
| 1,863,041 | A | 6/1932 | Dessauer |
| 1,878,991 | A | 9/1932 | Murray |
| 1,945,965 | A | 2/1934 | Behrman |
| 1,964,014 | A | 6/1934 | Wenk |
| 1,964,987 | A | 7/1934 | Harris |
| 1,982,438 | A | 11/1934 | Keidel |
| 1,987,351 | A | 1/1935 | Rose |
| 1,987,737 | A | 1/1935 | Goddard |
| 2,020,198 | A | 11/1935 | Miller |
| 2,497,434 | A | 2/1950 | Borland |
| 2,587,876 | A | 3/1952 | Moore |
| 2,599,700 | A | 6/1952 | Di'Palma |
| 2,809,065 | A | 10/1957 | Erke |
| 3,367,701 | A | 2/1968 | Wenk, Jr. |
| 3,375,033 | A | 3/1968 | Moberg |
| 3,591,223 | A | 7/1971 | Castro Neto |
| 3,712,655 | A | 1/1973 | Fuehrer |
| 3,736,017 | A | 5/1973 | Kaiho |
| 3,841,118 | A | 10/1974 | Stone |
| 3,954,294 | A | 5/1976 | Iwamoto et al. |
| 3,980,332 | A | 9/1976 | King, Sr. |
| 3,987,653 | A | 10/1976 | Lyon et al. |
| 4,106,801 | A | 8/1978 | Castro Neto |
| 4,175,782 | A | 11/1979 | Castro Neto |
| 4,502,305 | A | 3/1985 | Bakker |
| 4,512,599 | A | 4/1985 | Castro Neto |
| 4,687,240 | A | 8/1987 | Swift |
| 4,722,562 | A | 2/1988 | Burt |
| 4,733,893 | A | 3/1988 | Davis et al. |
| 4,736,604 | A | 4/1988 | Zeller et al. |
| 4,775,175 | A | 10/1988 | Swift |
| 4,782,613 | A | 11/1988 | Guiler et al. |
| 4,793,641 | A | 12/1988 | Sokol |
| 4,793,644 | A | 12/1988 | Swift |
| 4,802,700 | A | 2/1989 | Stevenson et al. |
| 4,818,002 | A | 4/1989 | Castro Netto |
| 4,832,387 | A | 5/1989 | Guiler |
| 4,836,590 | A | 6/1989 | Swift |
| 4,887,855 | A | 12/1989 | Tritton et al. |
| 4,893,853 | A | 1/1990 | Guiler |
| 4,909,552 | A | 3/1990 | Weber et al. |
| 4,940,268 | A | 7/1990 | Lesquir et al. |
| 4,968,075 | A | 11/1990 | Lesquir et al. |
| 4,991,889 | A | 2/1991 | Remark |
| 5,005,883 | A | 4/1991 | Guiler |
| 5,118,148 | A | 6/1992 | Castro Netto |
| 5,120,097 | A | 6/1992 | Fattori et al. |
| 5,127,687 | A | 7/1992 | Guiler |
| 5,180,200 | A | 1/1993 | Georgopoulos et al. |
| 5,314,219 | A | 5/1994 | Georgopoulos et al. |
| 5,345,657 | A | 9/1994 | Shimizu |
| 5,348,180 | A | 9/1994 | Shepard |
| 5,402,958 | A | 4/1995 | Mahaney |
| 5,419,599 | A | 5/1995 | Georgopoulos |
| 5,427,423 | A | 6/1995 | Georgopoulos |
| 5,452,930 | A | 9/1995 | Morgan |
| 5,489,034 | A | 2/1996 | Netto |
| 5,577,395 | A | 11/1996 | Kuykendall |
| 5,762,386 | A | 6/1998 | Fuehrer |
| 5,782,513 | A | 7/1998 | Nazzari |
| 5,788,294 | A | 8/1998 | Leon et al. |
| 5,871,243 | A | 2/1999 | Wenk |
| 6,000,736 | A | 12/1999 | Leon et al. |
| 6,007,121 | A | 12/1999 | Dreisbach et al. |
| 6,128,932 | A | 10/2000 | Mainetti et al. |
| D436,015 | S | 1/2001 | Yu |
| 6,227,016 | B1 | 5/2001 | Yu |
| 6,265,973 | B1 | 7/2001 | Brammall et al. |
| 6,283,517 | B1 | 9/2001 | Nazzari |
| D450,560 | S | 11/2001 | Yu |
| 6,389,854 | B1 | 5/2002 | Huang |
| 6,390,519 | B1 | 5/2002 | Dreisbach et al. |
| 6,416,091 | B1 | 7/2002 | Wenk et al. |
| 6,481,765 | B1 | 11/2002 | Jelavic |
| 6,550,829 | B1 | 4/2003 | Dobson |
| 6,578,886 | B1 | 6/2003 | Bystry et al. |
| 6,578,887 | B1 | 6/2003 | Kienzler |
| 6,588,812 | B1 | 7/2003 | Garcia et al. |
| 6,962,376 | B2 | 11/2005 | Palzkill et al. |
| 6,966,584 | B2 | 11/2005 | Debrody et al. |
| 6,981,725 | B2 | 1/2006 | Debrody et al. |
| 7,118,144 | B2 | 10/2006 | Anderson |
| 7,131,300 | B1 | 11/2006 | Monasco |
| D540,149 | S | 4/2007 | Tollefson |
| 7,226,095 | B2 | 6/2007 | Huang |
| 7,243,963 | B2 | 7/2007 | De Lima Castro |
| 7,270,353 | B2 | 9/2007 | Sironi et al. |
| D556,012 | S | 11/2007 | Tollefson |
| 7,336,170 | B2 | 2/2008 | Auerbach et al. |
| 7,370,892 | B2 | 5/2008 | Collingham |
| 7,438,334 | B2 | 10/2008 | Terry et al. |
| 7,472,933 | B2 | 1/2009 | Weedon et al. |
| D597,397 | S | 8/2009 | Nazzari |
| 7,612,669 | B2 | 11/2009 | Brigham |
| 7,696,886 | B2 | 4/2010 | Lai |
| 7,721,407 | B2 | 5/2010 | Littrell et al. |
| 7,740,292 | B1 | 6/2010 | Fattori et al. |
| 8,026,816 | B2 | 9/2011 | Chao Cheng |
| 8,485,572 | B2 | 7/2013 | Nazzari |
| 8,487,768 | B2 | 7/2013 | Lee et al. |
| 8,544,902 | B2 | 10/2013 | Remark et al. |
| 8,558,700 | B2 | 10/2013 | Chen |
| 2005/0023844 | A1 | 2/2005 | Huang |
| 2006/0119111 | A1 | 6/2006 | De Lima Castro |
| 2006/0266087 | A1* | 11/2006 | Hamilton et al. ..... 70/91 |
| 2007/0007776 | A1 | 1/2007 | Beard et al. |
| 2007/0040395 | A1 | 2/2007 | Lee |
| 2007/0210085 | A1 | 9/2007 | Robinson |
| 2011/0148127 | A1 | 6/2011 | Nazzari |
| 2011/0210567 | A1 | 9/2011 | Nazzari |
| 2012/0187701 | A1 | 7/2012 | Tsai |
| 2013/0026771 | A1 | 1/2013 | Nazzari |
| 2013/0259598 | A1 | 10/2013 | Debrody et al. |
| 2013/0277989 | A1 | 10/2013 | Nazzari |

FOREIGN PATENT DOCUMENTS

| | | | |
|---|---|---|---|
| EP | 1 088 762 | A1 | 4/2001 |
| EP | 2 249 328 | A1 | 11/2010 |
| FR | 2 678 328 | A1 | 12/1992 |
| FR | 2 714 991 | A1 | 7/1995 |
| GB | 2 025 856 | A | 1/1980 |
| GB | 2 168 654 | A | 6/1986 |
| GB | 2 256 618 | A | 12/1992 |
| IT | 660127 | | 1/1964 |
| WO | 99/22999 | A1 | 5/1999 |
| WO | 01/86615 | A2 | 11/2001 |
| WO | 02/05613 | A2 | 1/2002 |
| WO | 2010/099819 | A1 | 9/2010 |
| WO | 2010/151303 | A1 | 12/2010 |
| WO | 2013/003929 | A1 | 1/2013 |
| WO | 2013/016476 | A1 | 1/2013 |

OTHER PUBLICATIONS

International Search Report from PCT Application No. PCT/US97/19166, Jan. 28, 1998.

(56) References Cited

OTHER PUBLICATIONS

International Search Report and Written Opinion Regarding PCT/US2012/048225, Oct. 16, 2012.

International Search Report and Written Opinion Regarding PCT/US2013/036969, Jul. 26, 2013.

International Search Report and Written Opinion Regarding PCT/US2010/001749, Aug. 19, 2010.

* cited by examiner

FIG. 5
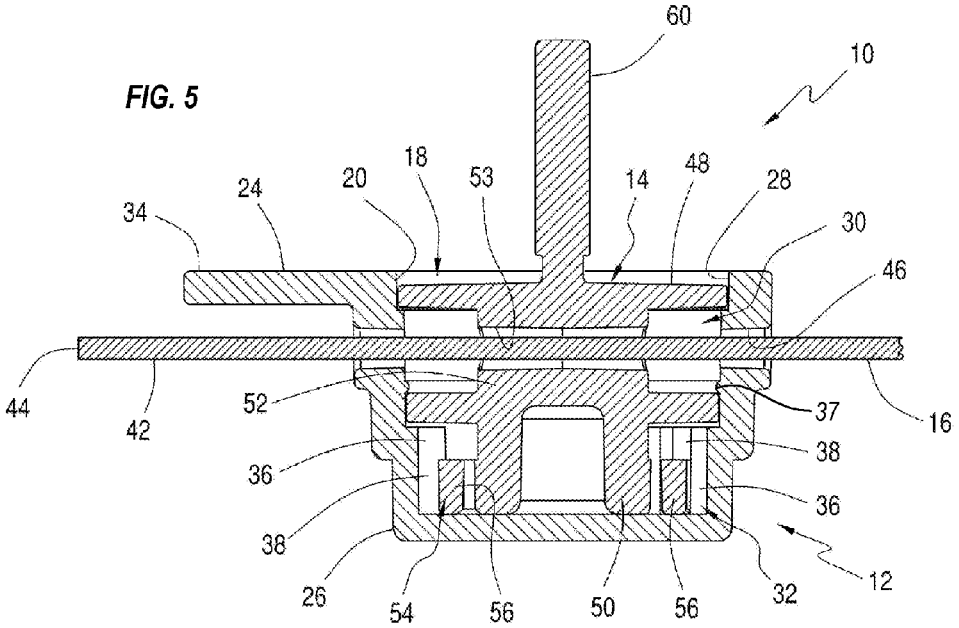
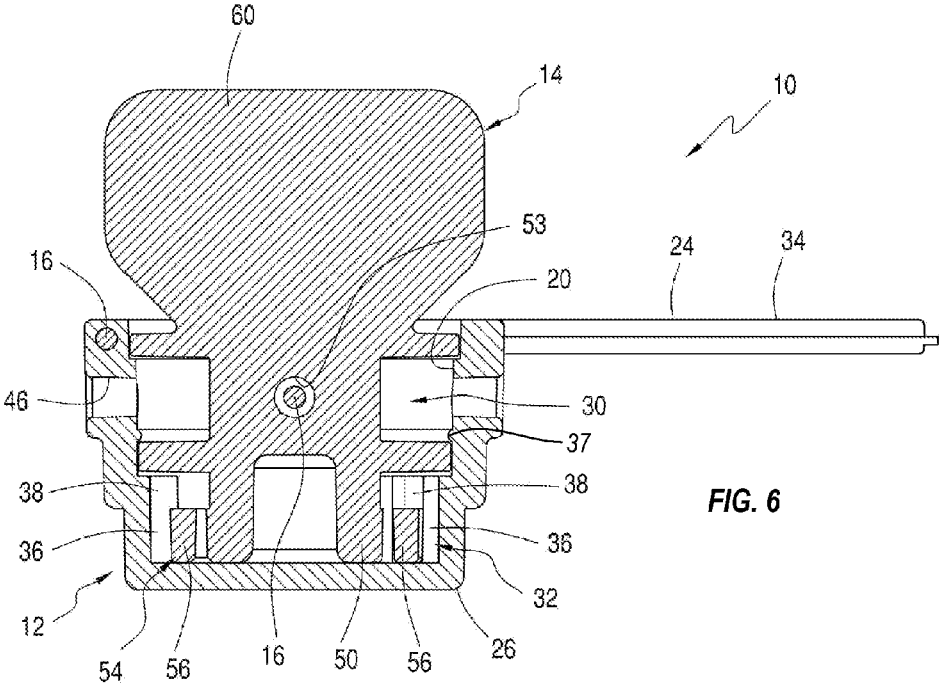
FIG. 6

ROTARY SECURITY SEAL

FIELD OF ART

The disclosure relates to the field of security seals, and more particularly to a rotary security seal assembly and a method for manufacturing a rotary security seal assembly.

BACKGROUND

Security seals for sealing container closures, meters, equipment and various other articles are used to reveal surreptitiously attempted or actual entry by damage to the seal. One conventional type of security seal includes a loop of locking filament that can seal an article when the loop of locking filament is threaded through the article and the loop is permanently secured at its opposite ends to the security seal by a one-way rotatable rotor within a socket of the housing body. Both of the free ends of the locking filament are irreversibly threaded and wound on the rotor through different bores.

Conventional rotary security seals such as these are typically made as an assembly of at least three pieces, namely a seal housing body having a socket, a rotor that is placed into a socket during assembly and a locking filament element of desired length that is initially separate from and independent of the security seal housing body and rotor. The rotor and socket in the housing body are arranged so that the rotor is irreversibly rotatable only in one direction within the socket.

For shipping to a customer, the manufacturer or shipper may irreversibly wind one end of the filament element on the rotor, and the customer is then expected to irreversibly wind the other end of the filament on the rotor. This can be problematic because irreversibly winding one end of the locking filament to the rotor prior to shipping can be labor intensive and time-consuming, increasing shipping and/or production costs. Moreover, because the manufacturer or shipper is partially assembling each security seal, the manufacturer or shipper typically packages, and/or ships the security seals as individual assemblies, which, in turn, can lower the efficiency of the production process.

If appropriate, the locking filament element may be shipped as a separate piece. Disadvantageously, this requires the person installing the security seal to irreversibly wind both ends of the filament on the rotor in the field to permanently secure both filament ends to the seal housing body. For instance, the person may be required to wind two ends of the filament sequentially or simultaneously through multiple bores through the housing and rotor to secure a container, closure, article or the like, which can be burdensome, frustrating and time consuming in the field.

In such known rotary seals, provision must also be made to enable two ends of the locking filament to be inserted through the housing body and the rotor and wound on the rotor, which requires extensive handling and manipulation to prepare the seals for shipment and for use in the field. Such a configuration thus typically requires two bores to be made in the housing body and the rotor to accommodate the two ends of the locking filament that must be inserted into and wound on the rotor.

In view of the shortcomings of conventional rotary seals, there exists a substantial need for a rotary security seal that is considerably improved in terms of actual handling in the field, production cost, and efficiency of shipping and packaging.

SUMMARY

Embodiments of the disclosure are related to an improved rotary security seal with a locking filament that is adapted to be threaded at least in part through a single receiving bore in a rotor and irreversibly wound on the rotor to properly seal an article or asset. This has the effect of making assembly and installation of the rotary security seal easier and faster than in the prior art. This also has the effect of reducing the complexity of the seal and lowering production costs.

In an embodiment of the present disclosure, the locking filament can be permanently secured to the seal housing body at one end thereof by hardenable molding material used to form the housing body. This process results in a molded housing body configured to receive the rotor of the seal assembly with a permanently captured locking filament secured at one end to the housing body by integrally formed molding material of the housing body, leaving only one free end area of the locking filament to be threaded through a closure or article to be sealed by an end user and irreversibly wound on the rotor to lock the seal.

The embodiment requires only a single bore to be provided through the socket of the housing body and rotor through which the free end area of the locking filament is to be inserted and irreversibly wound on the rotor by an end user to leave the loop of locking filament outside the housing body. Handling of a separately made filament after production of the housing body is thus avoided, as the locking filament is permanently secured at one end to the housing body during production. The end user is only required to manipulate the free end of the locking filament to create a loop that is threaded through the object to be secured by the security seal.

This embodiment and the process of its production can enable a producer to package the rotary security seal assemblies in an improved manner, so that multiple seal assemblies connected together temporarily by molding material used to form the seal housing bodies can be shipped and used in the field, with the end user breaking off each security seal assembly at the point of use and installation, leaving the other seal assemblies temporarily connected together. The locking filaments of the seal assemblies, permanently secured by molding material of the housing bodies to the housing bodies at one end of the filaments, can be configured during manufacture and packaging so that the free end areas of the locking filaments extend linearly or otherwise away from the seal housing bodies while the housing bodies are temporarily connected together by molding material to facilitate packaging of the seal assemblies by the producer, and handling and manipulation in the field of the seal assemblies as a group by the end user.

In another embodiment of the present disclosure, both ends of the locking filament are adapted to be threaded at least in part through a single locking filament receiving bore in the housing body and the rotor body. If desired, the end user, the producer, or shipper can thus handle the locking filament separately from the housing body prior to use. To seal an article, one end of the locking filament can be threaded through the article to be sealed and both ends of the locking filament can be threaded at least in part through the locking filament receiving bore and irreversibly wound on the rotor, leaving a loop of locking filament outside the housing body. This arrangement advantageously allows the locking filament to be handled separately from the housing body and avoids the difficulties and frustrations that can result when an end user attempts to thread a locking filament through multiple bores in both the housing body and the rotor body.

Additional features and advantages of embodiments of the present disclosure will be set forth in the description that follows, and in part will be obvious from the description, or may be learned by the practice of such exemplary embodiments. These and other features will become more fully apparent from the following description and appended claims, or may be learned by the practice of such exemplary embodiments as set forth hereinafter.

BRIEF DESCRIPTION OF THE DRAWINGS

Reference is made to the appended drawings depicting illustrative embodiments of the inventive subject matter to be described in more detail below, wherein:

FIG. 5 is a cross-section view of the assembly shown in FIG. 3 taken along line 5-5;

FIG. 6 is a cross-section view of the assembly shown in FIG. 3 taken along line 6-6;

DETAILED DESCRIPTION OF VARIOUS EMBODIMENTS

Figures 1, 2:
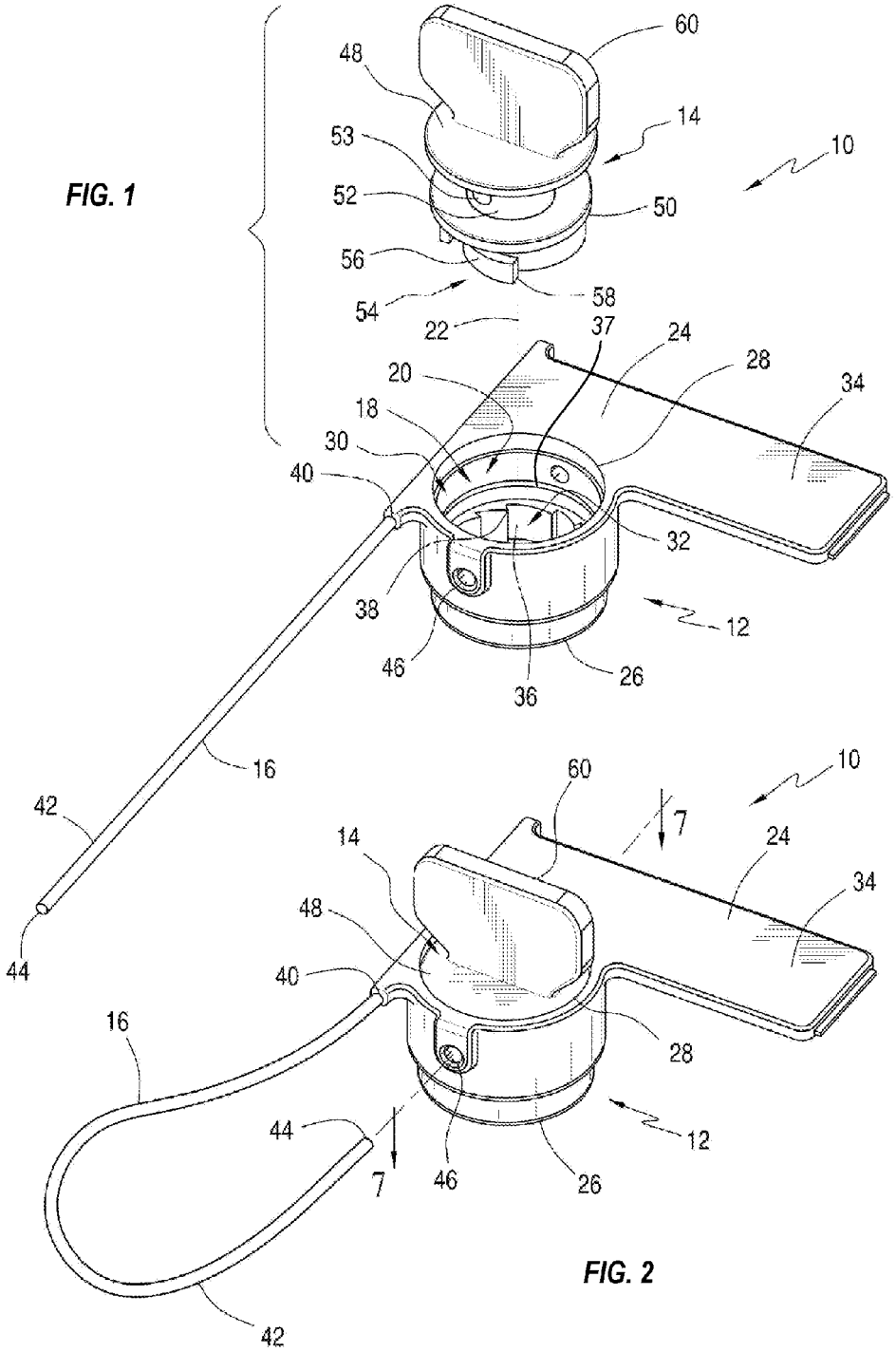
FIG. 1 is an exploded upper perspective view of a rotary security seal assembly according to an embodiment.
FIG. 2 is a view of the rotary security seal assembly shown in FIG. 1 in assembled form, with the rotor body inserted into the socket of the housing body.

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this patent to possess a described meaning, there is no intent to limit the meaning of such term, either expressly or indirectly, beyond its plain or ordinary meaning.

In the above description, the term "filament" is intended to mean any solid or stranded, thin, flexible element such as a plastic resin monofilament, metal wire, or thin cable that is appropriate for use in security seals that use filament loops to secure articles to be sealed.

Any element in a claim that does not explicitly state "means for", performing a specified function, or "step for", performing a specific function, is not to be interpreted as a "means" or "step" clause as specified in 35 U.S.C. §112, paragraph 6.

With reference to FIGS. 1-8, an exemplary embodiment of a rotary security seal assembly 10 is shown, comprising a housing body 12, a rotor body 14 and a locking filament 16.

As best seen in FIGS. 1 and 2, the housing body 12 can include an open socket 18 having a peripheral internal socket wall 20 and a socket central axis 22. The socket 18 may have any desired shape, but is shown having a generally circular or cylindrical shape. The housing body 12 can also include a housing top 24 and a housing bottom 26, and the socket 18 is arranged so that the top opening 28 of the socket 18 is located at or adjacent to housing top 24. The socket 18 includes an upper socket area 30 adjacent to the top opening 28 and a lower socket area 32 located towards the housing bottom 26.

The upper and lower socket areas 30, 32 can be concentric with socket central axis 22. The housing body 12 can be formed of a hardened molding material such as an initially liquid or flowable thermoplastic polymer resin or thermosetting plastic material that is injected or which otherwise flows into a mold cavity having a suitable form to create the desired housing body shape when hardened. While the housing body 12 is described comprising thermoplastic polymer resin or a thermosetting plastic material, it will be appreciated that other suitable materials are possible. For instance, the housing body 12 may comprise a rubber material, a metal material, a composite material, a polymer, a plastic material, a thermoplastic material, a resin, combinations thereof, or any other suitable material.

The housing body 12 optionally may include a tab portion 34. The tab portion 34 can help an end user manipulate the assembly 10 and/or can receive a tracking unit as described in more detail below.

The lower socket area 32 can include one-way detent features 36, for example, in the form of molded ratchet teeth 38 as illustrated. The ratchet teeth 38 can have sharply rising front rakes and less sharply rising rear rakes so as to present circumferentially spaced abutments for engaging pawl teeth on their front sides in a known manner.

The locking filament 16 can include a first end area 40 comprising a captured end area and a second end area 42 comprising a free end area. The locking filament 16 can be imbedded in hardened molding material forming the housing body 12 at the captured end area 40 terminating at a captured end (not shown), leaving the free end area 42 of the locking filament terminating at a free end 44.

As best seen in FIGS. 1 and 3-6, a housing locking filament receiving bore 46 can extend diametrically through the socket 18 of the housing body 12, intersecting the socket wall 20 at the upper socket area 30 and, in the example illustrated, the socket central axis 22, although the housing locking filament bore 46 could be displaced somewhat on either side of the socket axis 22. The housing locking filament receiving bore 46 can be the only bore extending through the socket 18. It will be appreciated that the housing locking filament receiving bore 46 can extend axially through the socket 18 or in any other appropriate orientation relative to the socket central axis 22. It will also be appreciated that the housing locking filament receiving bore 46 can extend completely or at least in a part through the housing body 12. The free end area 42 of the locking filament 16 with the free end 44 are configured to fit into and extend at least in part through the housing locking filament bore 46 in a manner to be described below.

As shown in FIGS. 2-8, the rotor body 14 can be inserted in the socket 18. The rotor body 14 can have a circular cross-section and a circular top area 48, a circular rotor bottom area 50, and a circular rotor central area 52 between the top and bottom areas, all area being concentric with each other. The rotor central area 52 can have a smaller diameter than the rotor top and bottom areas 48, 50.

As best shown in FIGS. 1 and 5, a rotor locking filament receiving bore 53 can transverse the rotor central area 50. The rotor locking filament receiving bore 53 can be dimensioned to receive a portion or a length of the locking filament free end area 42 when the assembly 10 is to be used and locked, as will be discussed in more detail below. The rotor locking filament receiving bore 53 can extend completely or at least in part through the rotor central area 50. The rotor locking filament receiving bore 53 can be the only bore extending through the rotor body 14. Further, while the rotor locking filament receiving bore 53 is described within the rotor central area 50, it will be appreciated that the rotor locking filament receiving bore 53 can be located in the top area 48, in the bottom area 50, or in any other suitable location within the rotor body 14. The rotor locking filament receiving bore 53 can further extend transversely, axially, or in any other suitable direction through the rotor body 14.

The rotor lower area 50 can have one-way locking pawl features 54 that, with the rotor body 14 fully received in the socket 18, cooperate with the socket one-way detent features 36 of the lower socket area 32 so as to function as a one-way, irreversibly rotating ratchet and pawl arrangement.

The locking pawl features 54 in the exemplary embodiment illustrated comprise flexible, leaf, spring-like spiral or involute shaped arms 56 extending away from the rotor bottom area 50 of the rotor body 14 in a single direction and terminating at ends 58 that engage the ratchet teeth 38 for irreversible, one-way rotation once the rotor body 14 is fully received in the socket 18 with the arms 56 biased outwardly so the ends 58 of the arms 56 engage respective ratchet teeth 38 of the socket one-way detent features in a known manner.

Figure 4:
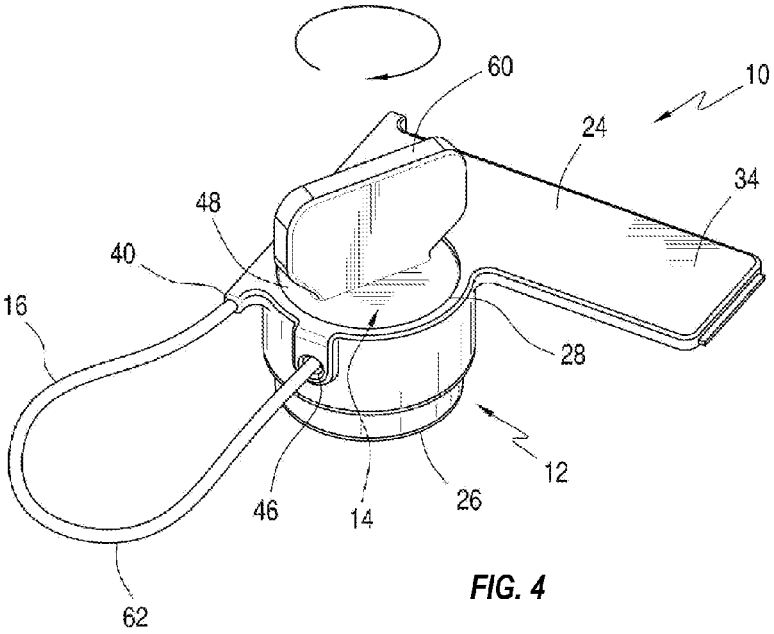
FIG. 4 is a view of the assembly of FIG. 3, with the rotor partially rotated to irreversibly wind the free end of the locking filament on the rotor body within the socket of the housing body to irreversibly secure the free end area of the locking filament to the housing body and rotor of the seal assembly.
Figure 7:
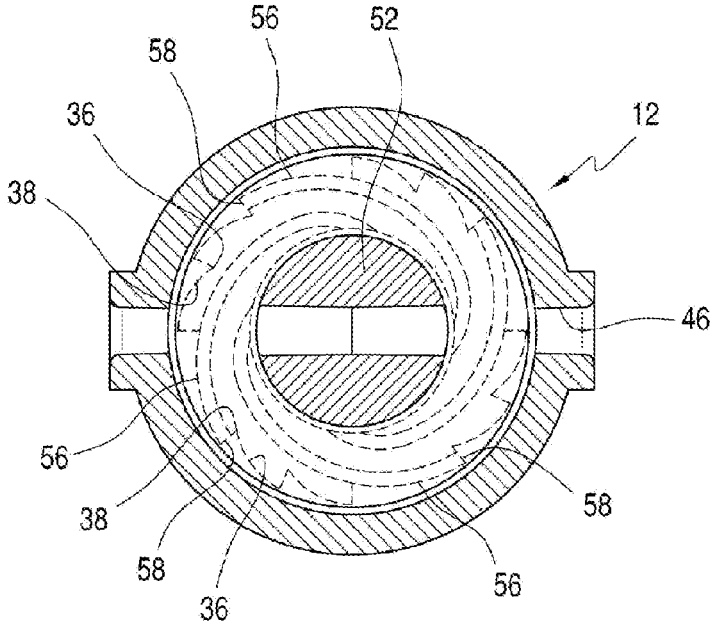
FIG. 7 is a cross-section view of the assembly shown in FIG. 2 taken along line 7-7.
Figure 8:
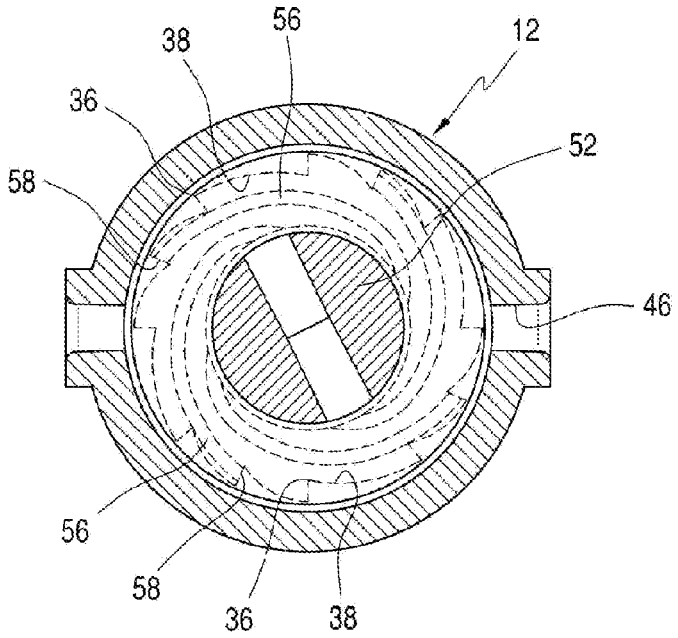
FIG. 8 is another cross-section view of the assembly shown in FIG. 7.

As best shown in FIGS. 4, 7, and 8, the arms 56 can be flexible in a spring-like manner and may pivot or flex resiliently, radially, or inwardly during assembly of the rotor body 14 to the housing body 12 when the rotor body 14 is inserted into the socket opening 18. The arms 56 may comprise one arm, two arms, four arms, or any other suitable number of arms. The ratchet teeth 38 and pawl arm ends 58 when engaged will restrict rotation of the rotor body 14 relative to the socket 18 in a clockwise winding direction only in an irreversible manner.

Figure 3:
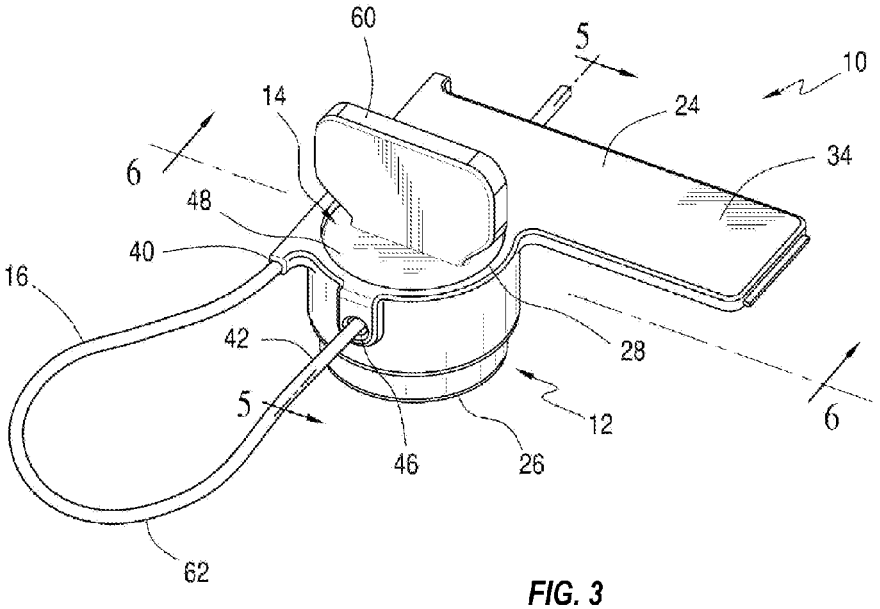
FIG. 3 is a view of the security seal assembly shown in FIG. 2 with the free end area of the locking filament illustrated as extending through filament receiving bores in the assembled housing body and rotor of the assembly.

As best shown in FIGS. 3-6, the rotor body 14 has an exemplary manipulating feature comprising a knob 60 at or adjacent to its top area 48 to enable rotation of the knob in a winding direction in a manner to be described below. The knob preferably is shaped to indicate "bore aligned" positions 180° apart in a rotational sense when the transverse housing locking filament bore 46 is aligned with the transverse rotor locking filament receiving bore 53 (shown in FIG. 7) to permit the free end 44 of the locking filament to be inserted through the housing body and the rotor at the rotor central area as seen in FIG. 3, with preferably a small length of free end area 42 of the locking filament extending beyond the housing body 12 on the other side from the entry side of the free end of the locking filament 16.

In the example shown, this "indexing" of the rotor body 14 relative to the housing body 12 can be enabled by dimensioning the ratchet teeth 38 in a manner such that they are unequally spaced circumferentially, with the arms 56 restricted to two beginning or starting positions 180° apart rotationally when the transverse bores 46 and 53 are aligned to receive a portion of the free end area 42 of the locking filament 16. Once the rotor is initially rotated away from the starting position seen in FIGS. 5 and 6, the ratchet teeth 38 and ends 58 of the arms 56 will determine the relative positions of rotation between the rotor body 14 and the socket 18 as seen in FIGS. 7 and 8.

As best seen in FIGS. 3, 5, and 6, the knob 60 can be a thin plate having flat sides lying in planes extending perpendicular to the transverse direction of the rotor locking filament receiving bore 53 in the rotor body 14, which will indicate when rotor locking filament receiving bore 53 is aligned with the housing locking filament bore 46 in the housing body by visual observation (comparing the position of the knob with the position of the housing locking filament bore 46).

In use, a person or end user installing the assembly 10 will thread a portion of the free end area 42 of the locking filament through the article to be sealed, for example, a hasp of a closure latch or aligned openings on a meter or article to be sealed, and then through the housing locking filament bore 46 and the bore 53 of the rotor body 14, with a portion of the locking filament 16 extending beyond the opposite side of the housing body 12 as shown in FIG. 3. Only one end of the locking filament 16 is threaded through the housing locking filament bore 46 and the rotor locking filament receiving bore 53. Such a configuration avoids the complications and frustrations that can result when two ends of a filament are required to be threaded through multiple bores in a housing body and a rotor.

In effect, a loop 62 of the locking filament 16 is formed to lock the assembly 10 to the article to be sealed. In this condition, the locking filament 16 intersects the rotor body 14 at its central area 52, which is surrounded by the socket wall 20 of the socket 18, with a volume between the rotor central area and the socket wall 20.

As best shown in FIG. 4, the person installing the assembly 10 then winds the knob 60 of the rotor body 14 in a clockwise or "winding" direction, so that the free end area 42 of the locking filament 16 is wound irreversibly clockwise and doubly around the rotor central area 52 in the volume between the central area 52 of the rotor body 14 and the socket wall 20 of the socket 18.

Due to the high friction capturing of the free end area of the locking filament around the rotor central area 52 the locking filament 16 cannot be withdrawn from the bore 46 of the housing body 12 and the bore 53 of the rotor body 14 without damaging an element of the seal assembly 10, which would provide a visible indication of unauthorized tampering with the seal.

The socket one-way detents features 36 described herein as well as the arrangement of the ratchet teeth 38 are to be regarded as exemplary only, as any suitable one-way or irreversible connection between the rotor body 14 and the socket 18 may be envisioned.

The tab portion 34 is an optional feature, and not a necessity by any means, and the use of such tab will depend on the needs of the end user of the rotary security seals.

The rotor bodies 14 may be secured in their respective sockets 18 by appropriate friction or snap-in connections that are known in the art or any suitable connection that enables simple assembly and manipulation of the rotor body in the socket of the housing body. For instance, the socket wall 20 may include a radial flange 37 or other suitable locking mechanism configured to retain or secure the rotor body 14 within the socket 18. As best seen in FIGS. 5 and 6, the radial flange 37 can function as a one-way stop by engaging an upper surface formed on the rotor central area 52 when the rotor body 14 is inserted within the socket 18. This advantageously can help prevent the rotor body 14 from being pulled out or coming out of the socket 18 after insertion while still permitting rotation of the rotor body 14 within the socket 18.

The rotor central area 52 is dimensioned and configured to accommodate a suitable length of locking filament 16 to be irreversibly wound thereon during use.

FIGS. 9-12 illustrate a simplified exemplary method of making the rotary seal assembly of the present disclosure using a molding technique, wherein a continuous locking filament 64 is placed in a lower mold half 66 that has mold cavities 68 arranged to receive a hardenable, flowable or formable molding material that will form molded seal housing bodies.

Figure 9:
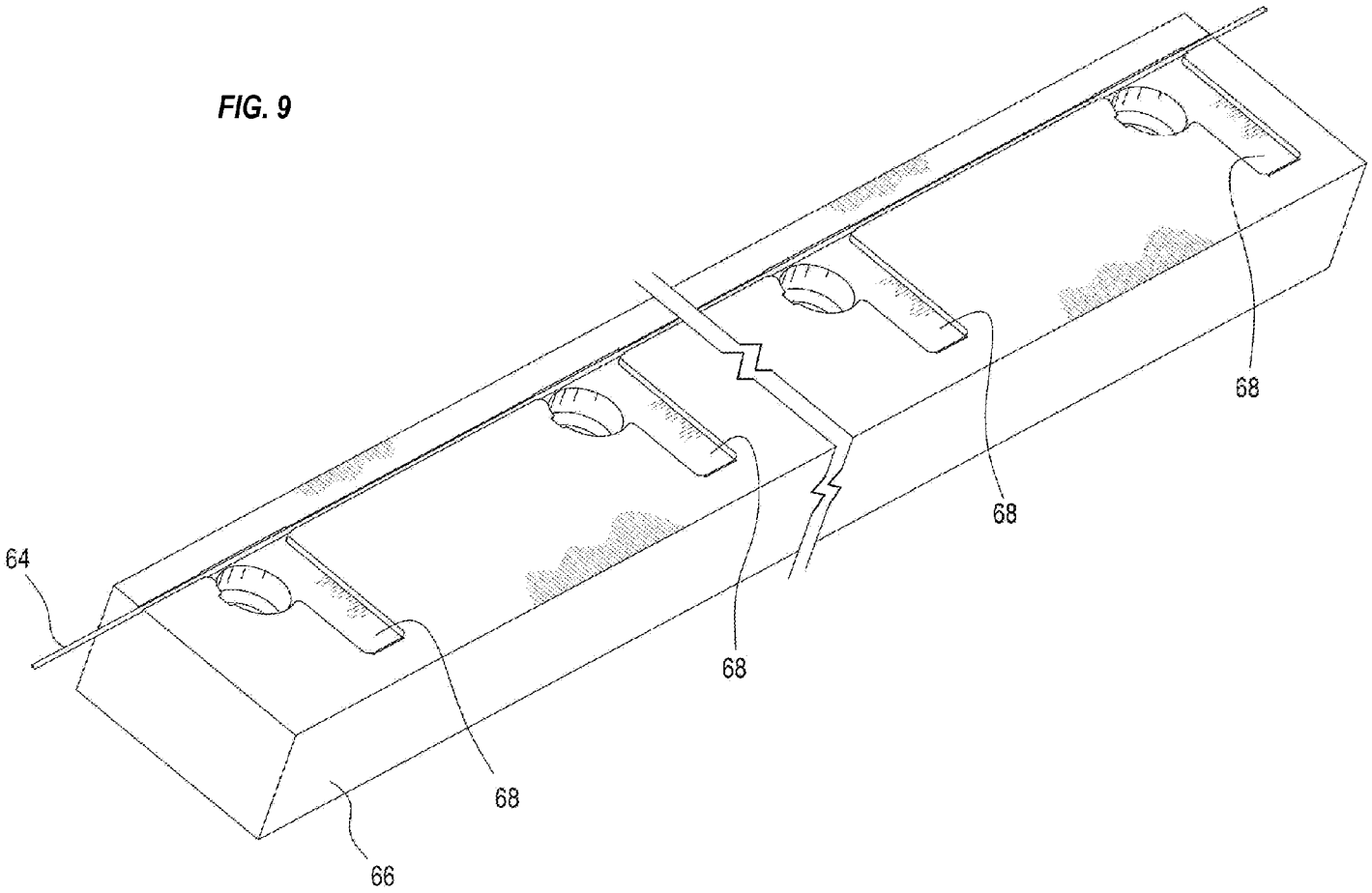
FIG. 9 is a simplified schematic illustration of a mold for molding multiple security seal housing bodies.

As seen in FIG. 9, the continuous locking filament 64 spans several mold cavities 68 in this example, which enables efficient production of multiple housing bodies with a single common locking filament with a single injection of moldable material.

Figure 10:
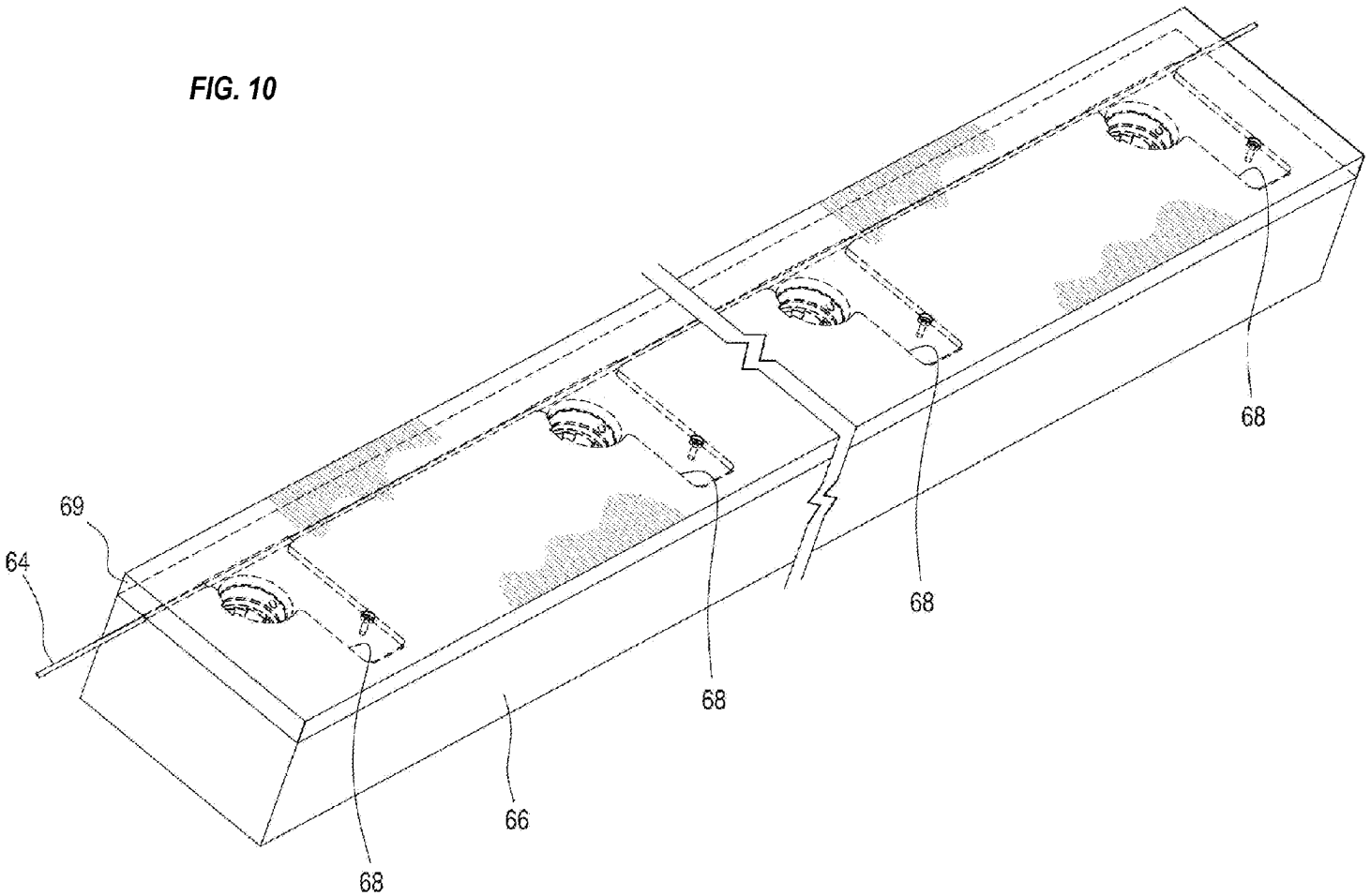
FIG. 10 shows the mold of FIG. 9 with the mold cavities closed and ready to receive hardenable molding material used to form the housing bodies of the rotary security seal assemblies.
Figures 11, 12:
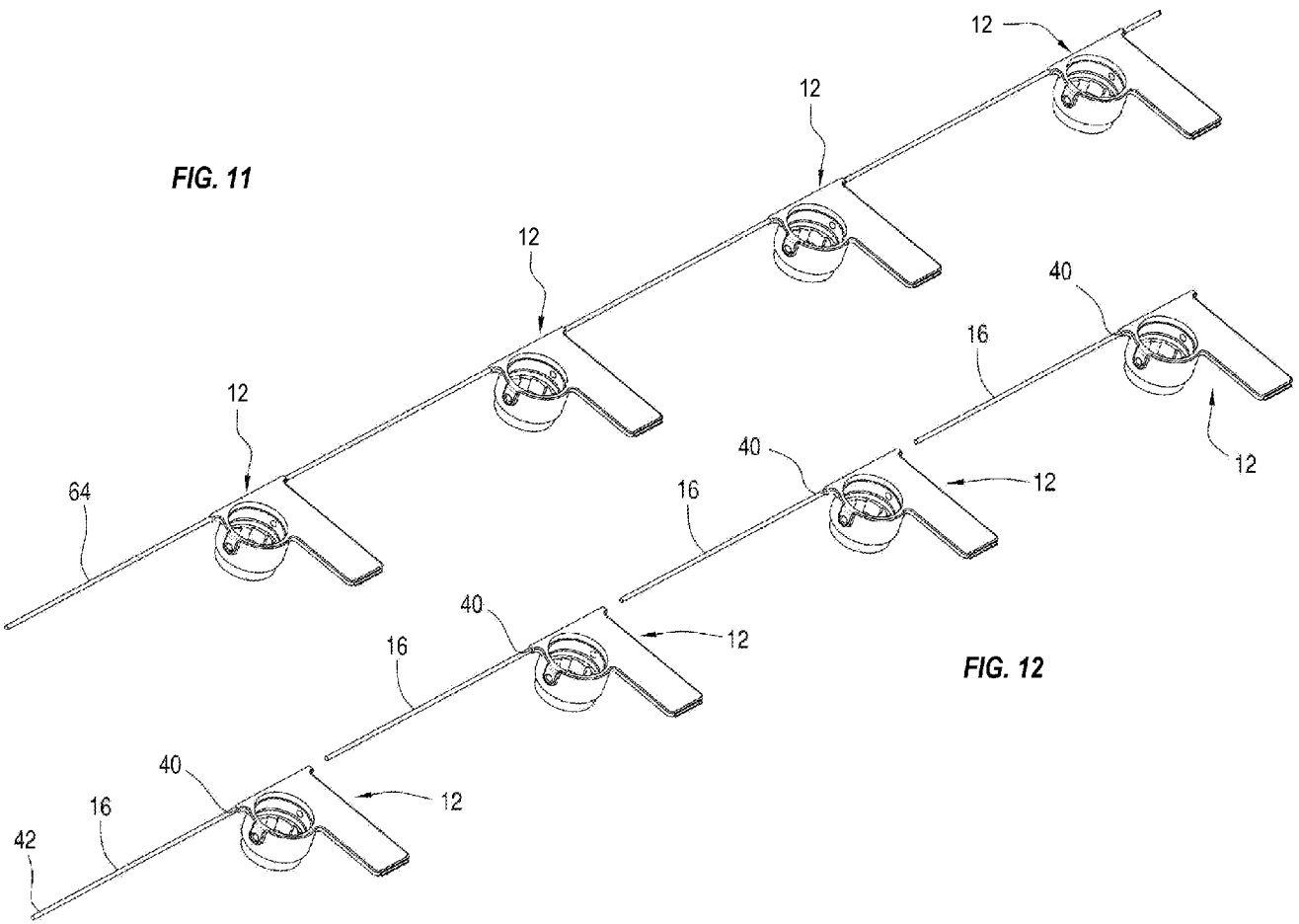
FIGS. 11 and 12 shows molded housing bodies as removed from the mold shown in FIGS. 9 and 10, with the locking filament initially intact and later cut to leave free end areas on each locking filament.

As shown in FIG. 10, an upper mold half 69 covers the lower mold half 66 to close mold cavities 68, with the continuous locking filament 64 spanning the mold cavities. Liquid or semi-liquid hardenable molding material (not shown) such as a thermoplastic or thermoset resin, for example, is injected into the mold cavities to form multiple seal housing bodies 12 (the cavities typically will be connected to enable the molding material to flow to all cavities), thereby producing the plurality of seal housing bodies 12 as seen in FIG. 11, all connected by the continuous locking filament 64. The continuous locking filament 64 thus is firmly bonded permanently at one captured end area to the housing bodies 12 by the molding material forming the housing bodies 12.

While the continuous locking filament is described being firmly bonded permanently to the housing bodies during an injection molding process, it will be appreciated that the continuous locking filament 64 can be firmly bonded permanently to the housing bodies 12 via any suitable method. For instance, the one captured end area of the continuous locking filament 64 may be firmly and permanently bonded to the housing bodies 12 via ultrasonic welding. In ultrasonic welding, high-frequency vibrations are directed at the locking filament 64 and the housing bodies 12 as they are held together. This can create a rapid build-up of heat that produces a weld or bond. This weld or bond can permanently secure the one captured end area of the continuous locking filament 64 to the housing bodies 12 and can be done during or subsequent to the molding process forming the housing bodies 12. In other embodiments, the one captured end area of the continuous locking filament 64 may be firmly and permanently bonded to the housing bodies 12 by mechanical connectors, soldering materials, adhesives, combinations thereof, or any other appropriate method.

To form the separate seal assemblies 10, the continuous locking filament 64 is cut or parted next to a respective housing body 12 as shown in FIG. 12. This technique leaves the now separate locking filament 16 comprising a first end area comprising the captured end area 40 and a free second end area comprising the free end area 42. At least part of the captured end area 40 is firmly bonded to the individual seal housing body 12 by hardenable molding material used to form the housing body 12. The opposite free end area 42 can be available to be inserted into the housing body locking filament receiving bore 46 by an end user of the seal assembly 10.

Alternate molding and production methods are illustrated in FIG. 13-16. The features of this embodiment are substantially similar to the embodiment discussed above.

Figure 13:
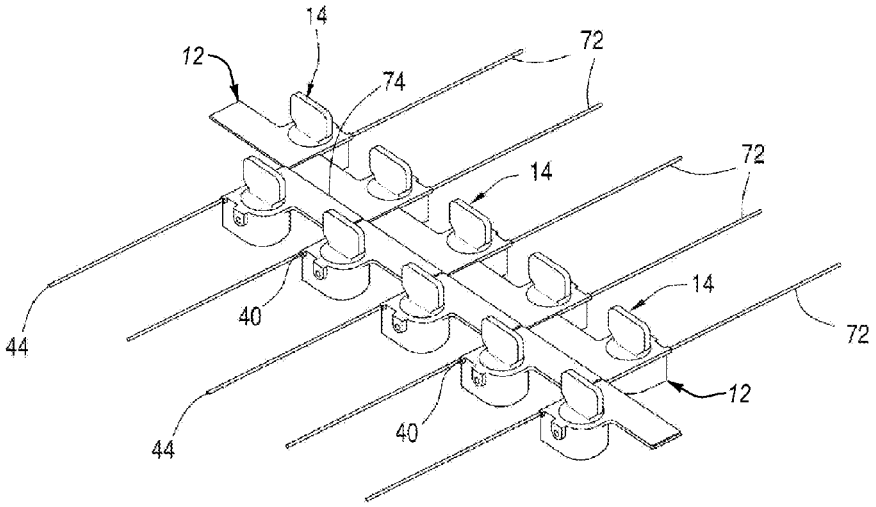
FIGS. 13-16 show security seal assemblies with the housing bodies having locking filaments attached to the bodies by hardened molding material with the housing bodies shown in various stages of separation to provide individual rotary security seal assemblies and with the locking filaments cut to individual lengths according to another embodiment.
Figure 14:
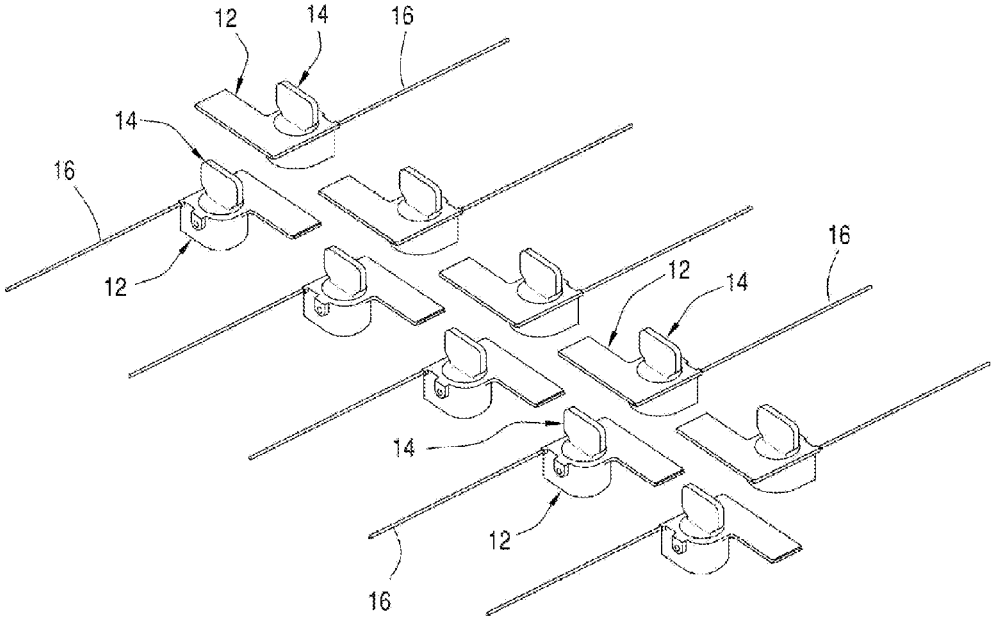

In FIGS. 13 and 14, multiple housing bodies 12 have been molded in connected condition, with mutual locking filaments 72 each spanning at least a pair of respective housing bodies 12 as shown. Large groups of similar molded seal housing bodies and mutual locking filaments could be molded simultaneously for efficiency. The rotor bodies 14 are added after the molding step and are shown here assembled to the housing bodies for a better understanding of the molding and assembly processes.

The connected security seal housing bodies 12 may be packaged in adjoining pairs as shown in FIG. 13, with the rotor bodies 14 and mutual locking filaments 72 all connected together for convenience of the packaging and handling of the seal assemblies. For packaging, the filaments 72 are cut between the housing bodies 12 to leave the locking filaments 16 attached to the seal housing bodies at their captured end areas 40, while leaving free end areas 42 of the locking filaments for manipulation by end users in the field.

In the packaged condition, as best shown in FIG. 13, the housing bodies 12 may be connected together by weakened fracture lines 74 of molding material that enable the housing bodies 12 to be easily separated from each other for individual use of the sealing assemblies by breaking or cutting the housing bodies apart. In the field, when the seal assemblies are to be used, the individual seal assemblies 10 are broken apart and the locking filaments 16 are manipulated for securing objects to be sealed as described above.

Figure 15:
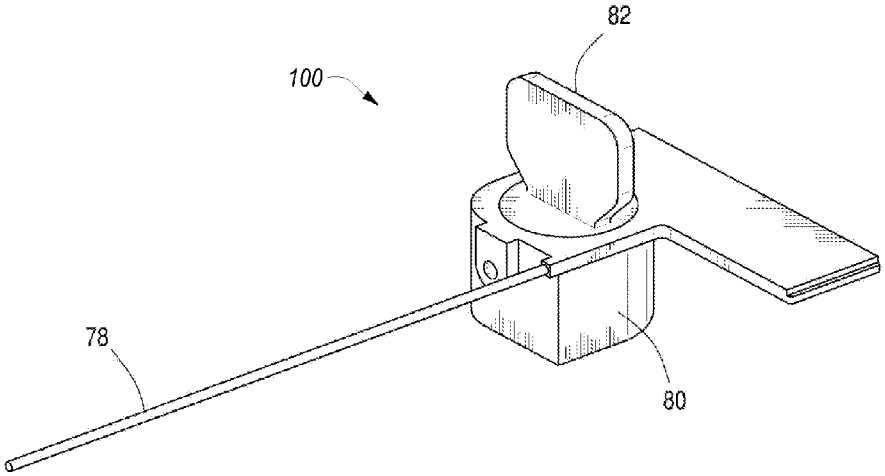
Figure 16:
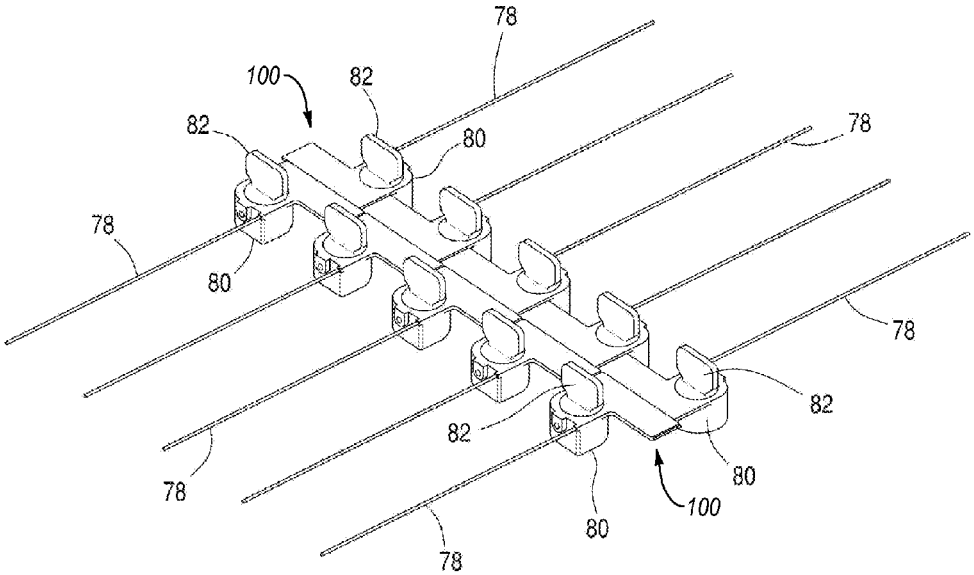

It will be appreciated that various schemes of molding the seal housings and filaments together are contemplated, but the disclosure is not to be limited in any manner by any of the molding or packaging method or materials described. Another embodiment of rotary security seal 100 in accordance with the present disclosure is shown in FIGS. 15 and 16. The features of this embodiment of a rotary security seal assembly 100 are substantially similar to the embodiment discussed above. Like the assembly 10, the assembly 100 generally includes a housing body 80, a rotor body 82, and a locking filament 78. The internal construction of the assembly 100, including the housing locking filament receiving bore, the rotor locking filament receiving bore, the locking pawl features, and the detent features are generally the same as discussed above with respect to the assembly 10, and these features are not further discussed here.

Like the assembly 10, the locking filament 78 of the assembly 100 has been connected to the housing body 80 by housing body molding material. The locking filament 78 however is connected to the housing body 80 at a different section of the housing body 80. Such a seal assembly could be molded as a group with other seal assemblies in the manner shown in FIG. 16, for example. It will be appreciated that the rotor bodies 82 can be added after molding of the housing bodies 80.

The examples shown in FIGS. 13-16 are intended to provide several optional molding and packaging techniques among many alternative possibilities, some of which involve firmly bonding the captured end area of a locking filament to a molded seal housing body by using the molding material used to form the housing body as the filament bonding material. These embodiments provide various packaging and handling choices that can increase convenience and efficiency of making and using the rotary security seals of the present disclosure.

While the housing body is described being fabricated via injection molding seal housing body, it will be appreciated that the seal housing body may be fabricated using any suitable fabrication method. For instance, the housing body may be fabricated using plastic welding, compounding, plastic lamination, blow molding, rotational molding, injection molding, plastic extrusion, plastic foaming, combinations thereof, or any other suitable fabrication processes or methods.

Figure 17:
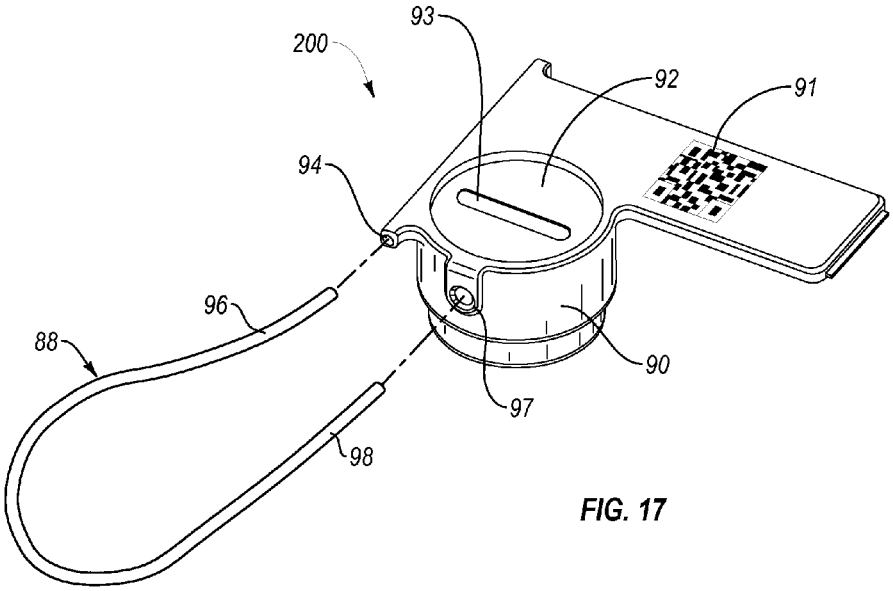
FIGS. 17 and 18 show a rotary security seal assembly and rotary security seal assemblies connected together with molding material according to another embodiment.
Figure 18:
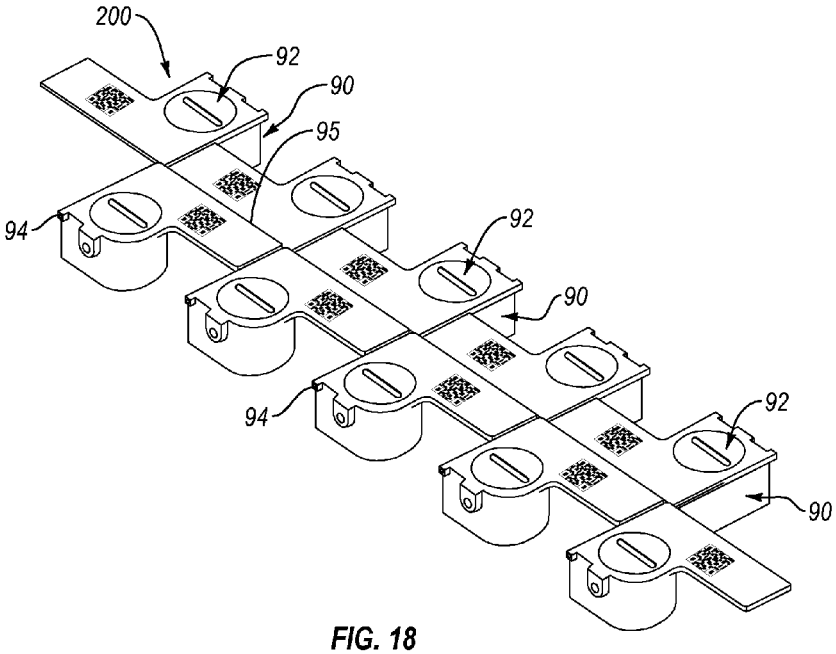

Another embodiment of a rotary security seal assembly 200 in accordance with the present disclosure is shown in FIGS. 17 and 18. The features of this embodiment of a rotary security seal assembly 200 are substantially similar to the embodiments discussed above.

In particular, like the assemblies 10 and 100, the assembly 200 generally includes three components, a housing body 90, a rotor body 92, and a locking filament 88. The internal construction of the assembly, including the housing locking filament receiving bore, the rotor locking filament receiving bore, the locking pawl features, and the detent features are generally the same as discussed above with respect to the assemblies 10 and 100, and these features are not further discussed here.

As best seen in FIG. 17, an attachment feature comprising an attachment bore 94 is formed in the top area of the housing body 90. The attachment bore 94 can be formed in any suitable manner. For instance, the attachment bore 94 can be formed in the housing body 90 during a molding process using one or more core pins. Alternatively, the attachment bore 94 can be formed subsequent to a molding process using secondary boring or drilling operations.

The attachment bore 94 can be located in any suitable location within the housing body 90, although the attachment bore 94 is shown extending at least part through the housing body and is located outside of the socket. The attachment bore 94 can extend generally perpendicular to a central axis of the housing body 90.

The locking filament 88 includes a first end area comprising an attachable end area 96 and a second end area comprising a free end area 98. The attachment bore 94 can be dimensioned and configured to receive the attachable end area 96 of the locking filament 88. In an embodiment, the attachable end area 96 of the locking filament 88 can be selectively inserted in the attachment bore 94 and selectively secured therein, leaving the free end area 98 of the locking filament 88 terminating at the free end outside the housing body 90. This allows the locking filament 88 to be inserted and/or attached to the housing body 90 for convenience when packaging the assemblies 200 and/or using one of the assemblies 200.

It will be appreciated that the attachable end area 96 of the locking filament 88 can be secured in the attachment bore 94 in any suitable manner, such as, but not limited to, a weld, an adhesive, the size and/or shape of the attachment bore 94, the size and/or shape of the locking filament 88, detents, mechanical fasteners, and/or locking teeth.

As also shown in FIG. 17, the rotor body 92 can include a slot 93 at or adjacent to the top area of the rotor body 92 to enable rotation of the rotor body 92 in a winding direction as described above. A person installing the assembly 200 can use a tightening tool (or key) or fingernail within the slot 93 to wind the rotor body 92.

In an embodiment, an end user or person installing the assembly 200 inserts and secures the attachable end area 96 of the locking filament 88 within the attachment bore 94. A portion of the free end area 98 is then threaded through an object or article to be sealed and at least in part through the housing locking filament receiving bore 97 and the rotor locking filament receiving bore. Only one end of the locking filament 88 is threaded through the housing locking filament receiving bore 97 and the rotor locking filament receiving bore. Such a configuration conveniently allows the locking filament to be handled separate from the housing body and avoids the complications and frustrations that can result when two ends of a locking filament are required to be threaded through multiple bores in a housing body and a rotor.

To seal the article, the person installing the assembly 200 then winds the rotor body 92 using the slot 93 in a winding direction so that the free end area 98 of the locking filament 88 is wound irreversibly around the rotor body 92 in the volume between the rotor body 92 and the housing body 90.

Referring still to FIG. 17, the housing body 90 can include a tracking unit 91 containing security or other information associated with the assembly 300 and/or the sealed article (e.g., an article or asset associated with the assembly 200). As shown, the tracking unit 91 can be located on a tab portion of the housing body 90. It will be appreciated however that the tracking unit 91 can be located at any suitable location on the assembly 200 and in any form. For instance, the tracking unit 91 can be integral to the housing body 90, the rotor body 92, and/or the locking filament 88.

The tracking unit 91 can comprise a security tag, a RFID tag, a printing, a label, an engraving, bar code information, serial number data, a chemical tag, or any other indicia suitable of providing a unique identifier and/or other appropriate information. The tracking unit 91 can include a unique identifier associated with the assembly 200 and/or the sealed article. In an embodiment, the tracking unit 91 can link and/or integrate the rotary security seal assembly 200 and/or the sealed article with an inventory/asset management system, such as any of the systems disclosed in U.S. patent application Ser. No. 14/270,539, filed May 6, 2014, which is incorporated herein, in its entirety, by this reference. Of course, other inventory/asset management systems may be possible.

The tracking unit 91 can be an encrypted code/identifier, such as an encrypted textual code (e.g., using combinations of numbers, letters, and/or symbols), an encrypted linear barcode, an encrypted 2D/matrix barcode (e.g., QR code, Aztec code), an encrypted 3D barcode, etc. An encrypted code/identifier is one that is resistant to being read by an unauthorized third party and/or that is resistant to being generated by an unauthorized third party. For example, tracking unit 91 can include a code/identifier presented on the rotary security seal assembly 200 in an encrypted form (e.g., by being encrypted using public key, symmetric, asymmetric, etc. encoding), so that the actual code/identifier cannot be deciphered without the proper encryption key(s) and cryptographic algorithms.

The tracking unit 91 may be generated using a cryptographic algorithm, so that valid code/identifiers cannot be generated without access to the applicable cryptographic algorithms and/or encryption keys(s). The tracking unit 91 can be generated using a cryptographic algorithm (thus making it difficult for a third party to generate valid codes/identifiers), and then the generated tracking unit 91 is also encrypted (thus making it difficult for a third party to read the actual code/identifier), thereby providing multiple layers of cryptographic protection. As such, encrypted codes/identifiers are usable to prevent unauthorized reading of codes/identifiers, unauthorized duplication of codes/identifiers, and unauthorized creation of new codes/identifiers for fraudulent security seal assemblies.

The tracking unit 91 may include both a machine-readable code/identifier (e.g., an encrypted code/identifier), and a separate human-readable identifier that is linked to the machine-readable code/identifier. For example, using the tracking unit 91, the rotary security seal assembly 200 may be identified by a human end user through entry of an identification string by the human user (e.g., numeric, alphanumeric, etc.) and the assembly can be verified through scanning of the machine-readable code/identifier of the tracking unit 91.

The tracking unit 91 may include a primary code (e.g., an encrypted QR code) and a secondary code (e.g., an ASCII code) that can be read if the primary code cannot be read or is unreadable. In addition, the tracking unit 91 can include one or more tamper-evidence features. For example, the tracking unit 91 may comprise a label or tape that leaves a clearly visible multilingual writing or warning on the tab portion of the housing body 90 and/or destructs if the label or tape is removed from the tab portion. The label or tape may comprise a clear tape with code/identifier information laser etched or otherwise included on the underside of the tape. If the tape is removed from the tab portion, the tracking unit 91 is destroyed or otherwise rendered undecipherable. In other embodiments, the tracking unit 91 can comprise a label or tape including one or more features configured to block out the code/identifier information and/or exhibit a void marking if the label or tape is removed from the housing body 90.

It will be appreciated that the tracking unit 91 may include one or more features making the label or tape easier to authenticate and/or more difficult to counterfeit. For example, the tracking unit 91 can include watermarks, color-shifting inks, low-vision features, holograms, embedded metals, embedded microchips, combinations thereof, or any other suitable security feature that can help authenticate the code/identifier and/or deter counterfeiting.

Similar to the assemblies 10 and 100, the assembly 200 can be molded as a group with other seal assemblies in the manner as shown in FIG. 18, for example. It will be appreciated that the rotor bodies 92 can be added after molding the housing bodies 90. For instance, the rotor bodies 92 can be auto loaded into the sockets of the housing bodies 90 after molding.

As shown in FIG. 18, the housing bodies 90 may be connected together by weakened fracture lines 95 of molding materials that enable the rotary security seal assemblies 200 to be separated from each other for individual use by breaking and/or cutting the housing bodies 90 apart.

As discussed above, the assemblies 200 can be fabricated and/or packaged in adjoining pairs and/or batches. For instance, the assemblies 200 can be fabricated and/or packaged in batches of six, eight, ten, twelve, twenty-four, or in any other suitable number. In the field, when the assemblies 200 are to be used, the individual assemblies 200 can be broken apart and the locking filaments 88 (shown in FIG. 17) can be inserted into the attachment bore 94 and manipulated for securing objects to be sealed as described above.

It will be appreciated that the attachment bore is to be regarded as exemplary only, as the first end area of the locking filament can be attached to the housing in any suitable manner. While the housing body and rotor body are described including locking filament receiving bores, in other embodiments, the housing body and/or the rotor body may include locking filament receiving slots, grooves, cutouts, combinations thereof, or any other suitable receiving feature.

Figure 19:
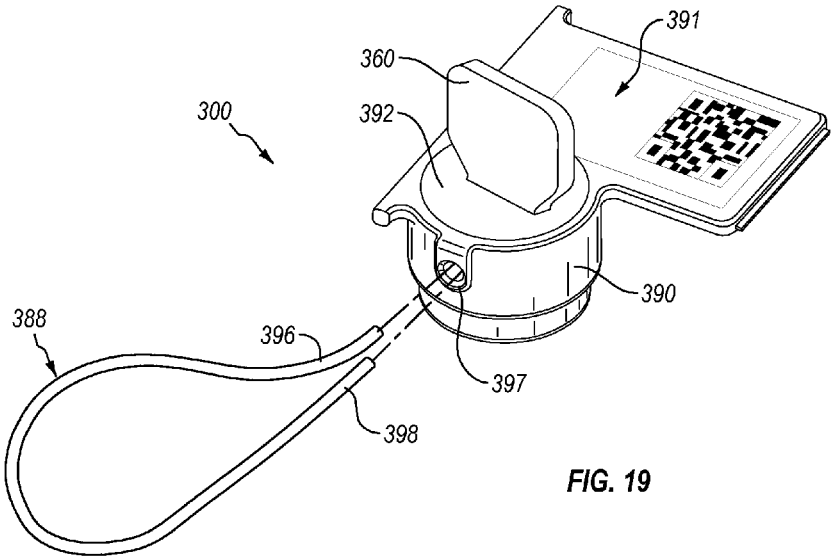
FIGS. 19 and 20 show a rotary security seal assembly and rotary security seal assemblies connected together with molding material according to another embodiment.
Figure 20:
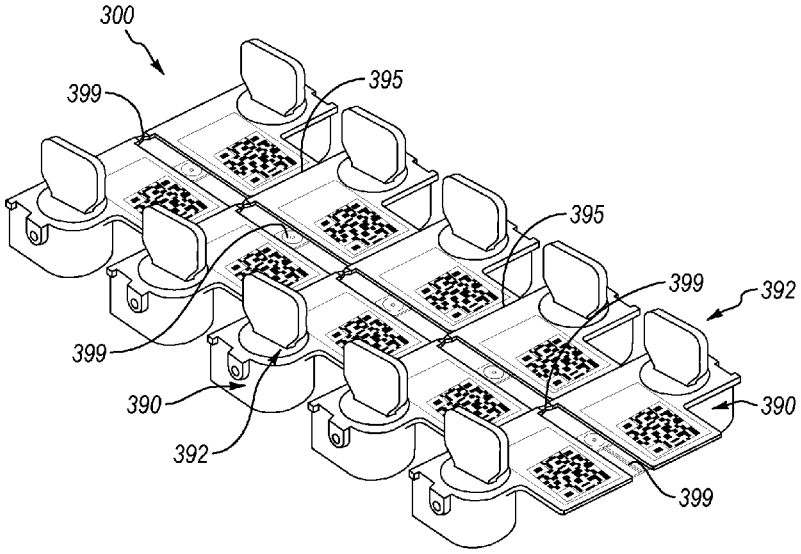

Another embodiment of a rotary security seal assembly 300 in accordance with the present disclosure is shown in FIGS. 19 and 20. The features of this embodiment of a rotary security seal assembly 300 are substantially similar to the embodiments discussed above.

In particular, like the assemblies 10, 100, and 200, the assembly 300 generally includes three components, a housing body 390, a rotor body 392, and a locking filament 388. The internal construction of the assembly, including the socket, the locking pawl features, and the detent features are generally the same as discussed above with respect to the assemblies 10, 100, and 200, and these features are not further discussed here.

The assembly 300 is configured such that the locking filament can be handled separately from the housing body and both ends of the locking filament 388 can be threaded through a single locking filament receiving bore. As shown in FIG. 19, the locking filament 388 can include a first end area 396 and a second end area 398. The housing locking receiving bore 397 and the rotor locking filament receiving bore (not shown) can be dimensioned and configured to receive both the first end area 396 and the second end area 398 of the locking filament 388.

In an embodiment, a person installing the assembly 300 threads one of the first end area 396 or the second end area 398 through an object or article to be sealed. The first end area 396 and the second end area 398 of the locking filament 388 are then threaded through the housing locking receiving bore 397 and the rotor locking filament receiving bore, leaving a loop of the locking filament 388 extending beyond the opposite sides of the housing body 390. Both end areas of the locking filament 388 are threaded through the same locking filament receiving bore. This arrangement advantageously allows the locking filament 388 to be handled separately from the housing body 390 and avoids the difficulties and frustrations that can result when a person attempts to thread a locking filament through multiple bores in both the housing body and the rotor body.

The person installing the assembly 300 then winds the knob 360 of the rotor body 392 in a winding direction so that at least one of the first end area 396 or the second end area 398 is wound irreversibly around the rotor body 392 in the volume between the rotor body 392 and the housing body 390. Similar to the assembly 200, the housing body 390 can include a tracking unit 391 containing security or other information associated with the assembly 300 and/or the sealed article.

Similar to the other embodiments, the assembly 300 can be fabricated or molded as a group with other seal assemblies in the manner as shown in FIG. 20, for example. In the illustrated embodiment, the assemblies are fabricated in a batch of ten. However, it will be appreciated that the assemblies can be fabricated in batches of six, eight, ten, twelve, twenty-four, or in any other suitable number. It will be appreciated that the rotor bodies 392 can be added after molding or fabricating the housing bodies 390.

As shown, the housing bodies 390 may be connected together by weakened fracture lines 395 and discrete weakened fracture connectors 399 of molding material that enable the rotary security seal assemblies 300 to be separated from each other for individual use by breaking and/or cutting the housing bodies 390 apart. The foregoing detailed description describes the disclosure with reference to specific exemplary embodiments. However, it will be appreciated that various modifications and changes can be made without departing from the scope of the present disclosure as set forth in the appended claims. The detailed description and accompanying drawings are to be regarded as merely illustrative, rather than as restrictive, and all such modifications or changes, if any, are intended to fall within the scope of the present disclosure as described and set forth herein.

More specifically, while illustrative exemplary embodiments of the disclosure have been described herein, the present disclosure is not limited to these embodiments, but includes any and all embodiments having modifications, omissions, combinations (e.g., of aspects across various embodiments), adaptations and/or alterations as would be appreciated by those in the art based on the foregoing detailed description.

The limitations in the claims are to be interpreted broadly based on the language employed in the claims and not limited to examples described in the foregoing detailed description, which examples are to be construed as nonexclusive. Moreover, any steps recited in any method or process claims may be executed in any order and are not limited to the order presented in the claims, unless otherwise stated in the claims. Accordingly, the scope of the disclosure should be determined solely by the appended claims and their legal equivalents, rather than by the descriptions and examples given above.

The invention claimed is:

1. A rotary security seal assembly comprising:

a housing body defining a socket including a top opening, a tab portion at or near the top opening of the socket, and a housing locking filament receiving bore extending at least in part through the housing body and intersecting the socket, wherein the socket includes a peripheral socket wall and a plurality of peripheral socket one-way detent features located along the peripheral socket wall, the peripheral socket one-way detent features comprising solid molded ratchet teeth;

a locking filament including:

a first end area permanently secured to the housing body by hardened molding material forming the housing body, the first end area extending through at least part of the tab portion outside of the socket; and a second end area dimensioned and configured to be received in and extended at least in part through the housing locking filament receiving bore leaving a continuous locking filament loop outside the housing body when so received; and a rotor body receivable in the socket and including a central body area and a rotor locking filament receiving bore extending at least in part through the rotor body and intersecting the central body area, wherein the second end area of the locking filament is dimensioned and configured to be received in and extend at least in part through the housing locking filament receiving bore and the rotor locking filament receiving bore when the bores are substantially aligned and the rotor body is received within the socket leaving the continuous locking filament loop outside the housing body when the second end area is so received.

2. The assembly of claim 1, wherein the housing locking filament receiving bore comprises the only bore intersecting the socket, and wherein the rotor locking filament receiving bore comprises the only bore intersecting the central body area.

3. The assembly of claim 1, wherein the rotor body includes rotor one-way pawl features configured to engage the socket one-way detent features to enable one-way only relative rotation of the rotor body relative to the socket in a winding direction when the rotor body is received in the socket.

4. The assembly of claim 3, wherein the rotor one-way pawl features comprises at least one involute arm.

5. The assembly of claim 3, wherein upon insertion of the second end area of the locking filament at least in part through the housing locking filament receiving bore and the rotor locking filament receiving bore and with rotation of the rotor body in the winding direction within the socket, the second end area of the locking filament is irreversibly secured to the rotor body by forming a winding or windings around the rotor body within the socket, with the locking filament loop remaining outside the housing body.

6. A batch of rotary security seal assemblies comprising: a plurality of the rotary security seal assemblies and a locking filament, each of the rotary security seal assemblies including: a housing body defining a socket including a top opening, a tab portion at or near the top opening of the socket, and a housing locking filament receiving bore extending at least in part through the housing body and intersecting the socket; and a portion of the locking filament including: a first end area permanently secured to the housing body by hardened molding material forming the housing body, the first end area extending through at least part of the tab portion outside of the socket; and a second end area dimensioned and configured to be received in and extended at least in part through the housing locking filament receiving bore leaving a continuous locking filament loop outside the housing body when so received, wherein the housing bodies are mutually connected together along weakened fracture zones at least in multiple pair sets by the hardened molding material forming the housing bodies and the locking filament extending through and between the housing bodies, and wherein the rotary security seal assemblies are separable from one another such that the second end area of each portion of the locking filament is free to be received in the housing locking filament receiving bore.

7. The batch of claim 6, wherein the locking filament connects four housing bodies.

8. A housing and locking filament assembly fora rotary security seal comprising:

a housing body having a housing top and housing bottom, and formed of hardened molding material;

a circular open socket in the housing body having a socket axis and being defined by a peripheral socket wall, a top opening disposed at or adjacent the housing top, an upper socket area adjacent to the top opening, and a lower socket area located towards the housing bottom, said upper and lower socket areas concentric with each other and the socket axis, said housing body having a single locking filament receiving housing bore extending through the housing body transversely of and intersecting the socket, with portions of said housing bore intersecting the socket wall at the upper socket area;

a tab portion connected to the housing body, the tab portion including atop surface defined by the housing top; and a locking filament having a captured end area terminating at a captured end and a free end area terminating at a free end, said captured end area permanently secured to the housing body and extending at least in part through the tab portion outside of the socket, said locking filament free end area dimensioned so as to be receivable in and extend at least in part though the housing bore leaving a continuous locking filament loop outside the housing bore.

9. The assembly of claim 8, further comprising a plurality of peripheral socket one-way detent features located along the peripheral socket wall.

* * * * *